US007264451B2

(12) United States Patent
Park

(10) Patent No.: US 7,264,451 B2
(45) Date of Patent: Sep. 4, 2007

(54) FRAME OF RECIPROCATING COMPRESSOR

(75) Inventor: Kyeong-Bae Park, Seoul (KR)

(73) Assignee: LG Electronics Inc., Seoul (KR)

( * ) Notice: Subject to any disclaimer, the term of this patent is extended or adjusted under 35 U.S.C. 154(b) by 711 days.

(21) Appl. No.: 10/653,886

(22) Filed: Sep. 4, 2003

(65) Prior Publication Data

US 2004/0057844 A1 Mar. 25, 2004

(30) Foreign Application Priority Data

Sep. 25, 2002 (KR) ..... 10-2002-0058227

(51) Int. Cl.
*F04B 17/04* (2006.01)
*F01B 11/02* (2006.01)
*F01M 11/00* (2006.01)

(52) U.S. Cl. ..... 417/417; 92/171.1; 184/6.28

(58) Field of Classification Search ..... 417/417; 92/171.1; 184/6.28
See application file for complete search history.

(56) References Cited

U.S. PATENT DOCUMENTS 6,202,791 B1 * 3/2001 Oh et al. ..... 184/6.16
6,960,067 B2 * 11/2005 Jung et al. ..... 417/417

* cited by examiner

*Primary Examiner*—Charles G Freay
(74) *Attorney, Agent, or Firm*—Greenblum & Bernstein, P.L.C.

(57) ABSTRACT

A frame of a reciprocating compressor includes a main frame having a cylindrical insertion hole to receive a cylinder of a compression unit along a center axis thereof and a flange that supports an outer stator of a reciprocating motor at the outer circumference of the flange. A sub frame is engaged to the main frame by an engaging device and positioned to cover an outer circumferential surface of the cylinder to form an oil flow path in a space between the main frame and the cylinder.

20 Claims, 6 Drawing Sheets

FRAME OF RECIPROCATING COMPRESSOR

RELATED APPLICATIONS

The present disclosure relates to subject matter contained in Korean Application No. 2002-0058227, filed on Sep. 25, 2002, which is expressly incorporated herein by reference in its entirety.

BACKGROUND OF THE INVENTION

1. Field of the Invention

The present invention relates to a frame of a reciprocating compressor, and more particularly, to a frame of a reciprocating compressor composed of two components and having an oil flow path provided therein when the two frame components are assembled.

2. Description of the Background Art

Generally, a compressor is an apparatus for compressing a refrigerant gas under the condition of low temperature and pressure, which is introduced from an evaporator, and discharging the gas by changing the condition to high temperature and pressure.

Compressors can be classified as rotary compressors, reciprocating compressors and scroll compressors according to the method of compressing the fluid.

Particularly, the reciprocating compressor takes in by suction and compresses the fluid while a piston moves linearly. The operational method of the reciprocating compressor is divided into a method which compresses fluid by converting the rotary movement of a driving motor into a reciprocating movement of the piston, and a method which takes in a fluid by suction and compresses the fluid by having the piston perform a reciprocating movement as the driving motor performs a linear reciprocating movement.

FIG. 1 is a longitudinal sectional view showing a conventional reciprocating compressor, FIG. 2 is a perspective view showing a frame of the conventional reciprocating compressor, and FIG. 3 is an enlarged sectional view of a portion of FIG. 1.

As shown in FIG. 1, the conventional reciprocating compressor includes a case 10 having a gas suction pipe SP, gas discharge pipe DP, and a supporting member 20 installed inside the case 10. A reciprocating motor 30 is fixed to the supporting member 20 for reciprocating a movable element 33, a compression unit 40 for taking-in, compressing and discharging gas by the movable element 33 of the reciprocating motor 30 are provided. A resonance spring unit 50 elastically supports the movable element 33 of the reciprocating motor 30 in the movement direction, and a supply unit 60, mounted at the supporting member 20, supplies oil to the compression unit 40.

The supporting member 20 comprises a frame 21 for supporting the reciprocating motor 30 and the compression unit 40, a middle cover 22 for supporting an outer stator 31 of the reciprocating motor 30, and a back cover 23 for supporting the resonance spring unit 50.

A boss 21B having an insertion hole 21*a* is formed at the center portion of the frame 21 and a flange 21A is formed at the outer circumference thereof (FIG. 2).

A cylinder 41 which will be explained later is inserted into the insertion hole 21*a*, and an inner stator 32 is installed at the outer circumference of the flange 21A.

The reciprocating motor 30 comprises an outer stator 31 installed between the frame 21 and the middle cover 22, an inner stator 32 which is spaced from the outer stator 31 by a predetermined interval and fixed to the frame 21, a movable element 33 installed between the outer stator 31 and the inner stator 32 for performing a linear reciprocating movement, and a coil 34 to which electric current flows.

The compression unit 40 comprises: a cylinder 41 integrally formed in the frame 21, a piston 42 engaged to the movable element 33 of the reciprocating motor 30 for performing a reciprocating movement in a compression space P of the cylinder 41, a suction valve 43 mounted at the front end of the piston 42 for controlling suction of refrigerant gas by opening and closing a suction path F (FIG. 3) of the piston 42 and a discharging valve assembly 44 mounted at a discharge side of the cylinder 41 for controlling discharge of compression gas by opening and closing the compression space P.

The oil supply unit 60 comprises an oil pumping portion 61 for pumping oil in the case 10, and an oil supply path 62 formed at the supporting member 20 to connect an outlet of the oil pumping portion 61 and the compression unit 40.

As shown in FIG. 3, the oil supply unit 62 comprises a suction hole 62*a* extending from the frame 21 to an inner circumference surface of the cylinder 41, a first oil pocket 62*b* formed at the inner circumference surface of the boss 21B of the frame 21 by being connected to the oil suction hole 62*a*, an oil opening 62*c* formed to penetrate the cylinder 41 for connecting the first oil pocket 62*b* to the outer circumference surface of the piston 42 and a second oil pocket 62*d* in contact with the oil opening 62*c* and formed concavely with a ring shape at the outer circumference surface of the piston 42. An oil discharge hole 62*e* is formed to extend from the upper front side of the first oil pocket 62*b* to the outer side of the flange 21A and an oil recollecting path 62*f* in contact with the oil discharge hole 62*a* for recollecting oil.

The conventional reciprocating compressor operates as follows.

When a flux is formed between the outer stator 31 and the inner stator 32 by applying current from a power source to the reciprocating motor 30, the movable element 33 elastically performs a reciprocating movement by the resonance spring unit 50. At this time, as the piston 42 performs a reciprocating movement inside the cylinder 41, the volume of the compression space P is changed, and the gas is taken-in, compressed, and discharged, which processes are sequentially repeated.

At the same time, the oil pumping portion 61 pumps oil in the case 10. The oil passes through an oil discharge valve to pass into the oil suction hole 62*a*, the first oil pocket 62*b*, and the oil opening 62*c* and flows into the second oil pocket 62*d*, thereby cooling parts near the compression unit and provides lubrication between the piston 42 and the cylinder 41.

Then, oil of the second oil pocket 62*d* is recollected by returning to the case 10 through the oil discharge hole 62*c* and along the oil recollecting path 62*f*.

In the conventional reciprocating compressor, the frame 21 in which the flange 21A and the boss 21B are provided, is formed as a unitary member (FIG. 2).

However, in the conventional reciprocating compressor, the frame has to be formed as a three dimensional shape in order to receive the outer stator of the motor, the inner stator, the cylinder, and the discharging valve assembly therein. Accordingly, many sophisticated manufacturing processes are required, the fabricating process becomes difficult, the fabricating cost is increased, and a reliability of the compressor is degraded when wrong processing is performed.

Also, in case of expanding an area of the oil path so as to increase the oil inflow amount for effective lubrication and cooling of the compression unit, it is difficult to process (i.e., fabricate) the oil supply path. Accordingly, there is a restriction in properly controlling the inflow amount of the oil.

SUMMARY OF THE INVENTION

Therefore, an object of the present invention is to provide a frame of a reciprocating compressor which can easily provide an oil flow path area and reduce a fabrication cost by fabricating a main frame and a sub frame separately and forming a plurality of oil flow paths therein when the two frames are assembled.

To achieve these and other advantages and in accordance with the purpose of the present invention, as embodied and as broadly described herein, there is provided a frame of a reciprocating compressor comprising a main frame having a cylindrical insertion hole configured to receive a cylinder of a compression unit along a center axis thereof and a flange to support an outer stator of a reciprocating motor at the outer circumference of the flange. A sub frame is engaged to the main frame and positioned to cover an outer circumferential surface of the cylinder to form an oil flow path in a space between the main frame and the cylinder.

The main frame is formed to have a disc shape, and the sub frame engaged therewith is formed to have a cylindrical shape.

A flange is formed at one end portion of the sub frame to engage with the main frame, and an inner stator installation surface to install an inner stator is formed at the other end portion thereof.

A stopping step that fixes the inner stator is formed at one side of the inner stator installation surface and a stopping member is formed at another side thereof.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A frame of a reciprocating compressor according to the present invention will be explained with reference to the attached drawings.

Figure 4:
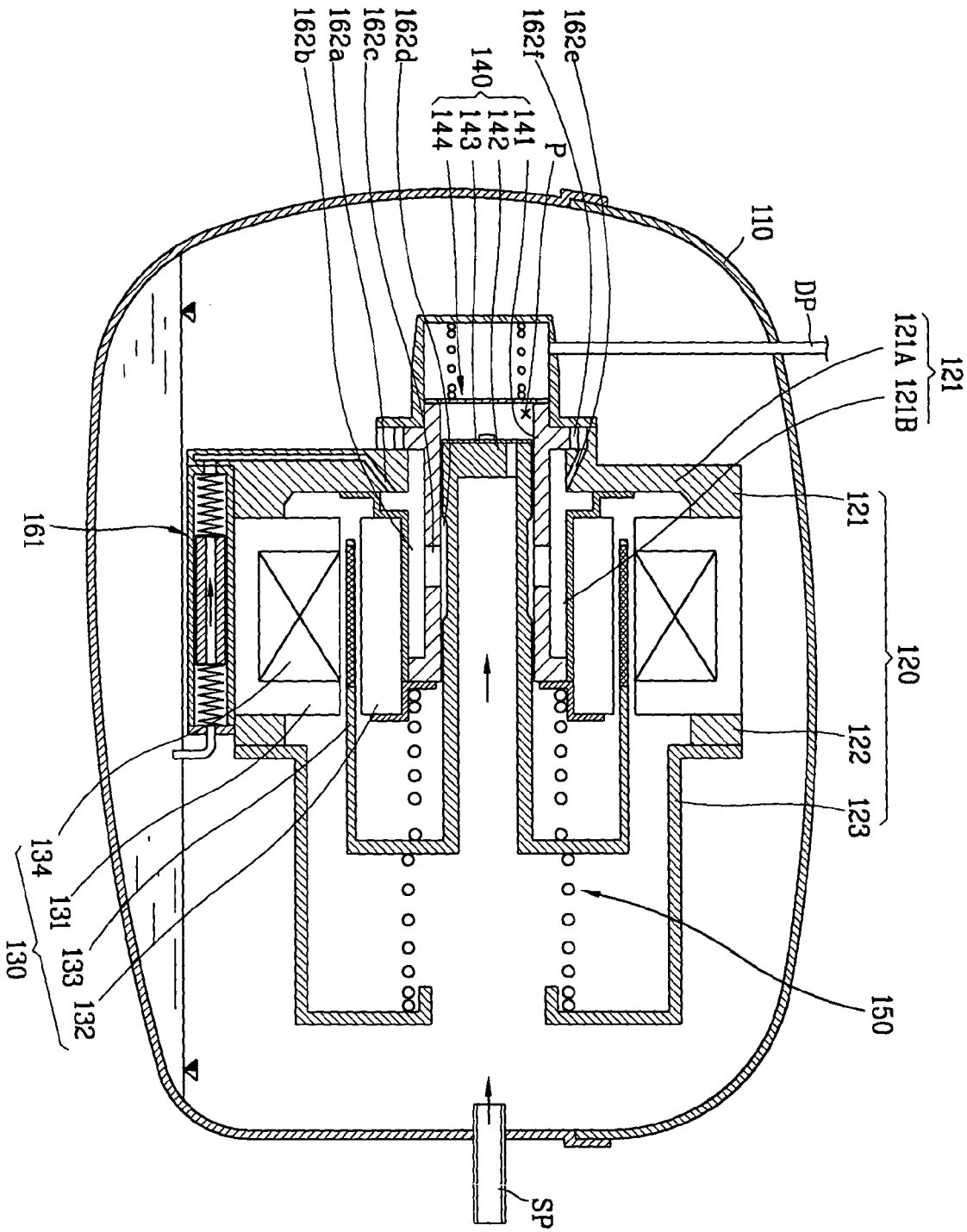
FIG. 4 is a longitudinal sectional view showing a reciprocating compressor according to the present invention.
Figure 5:
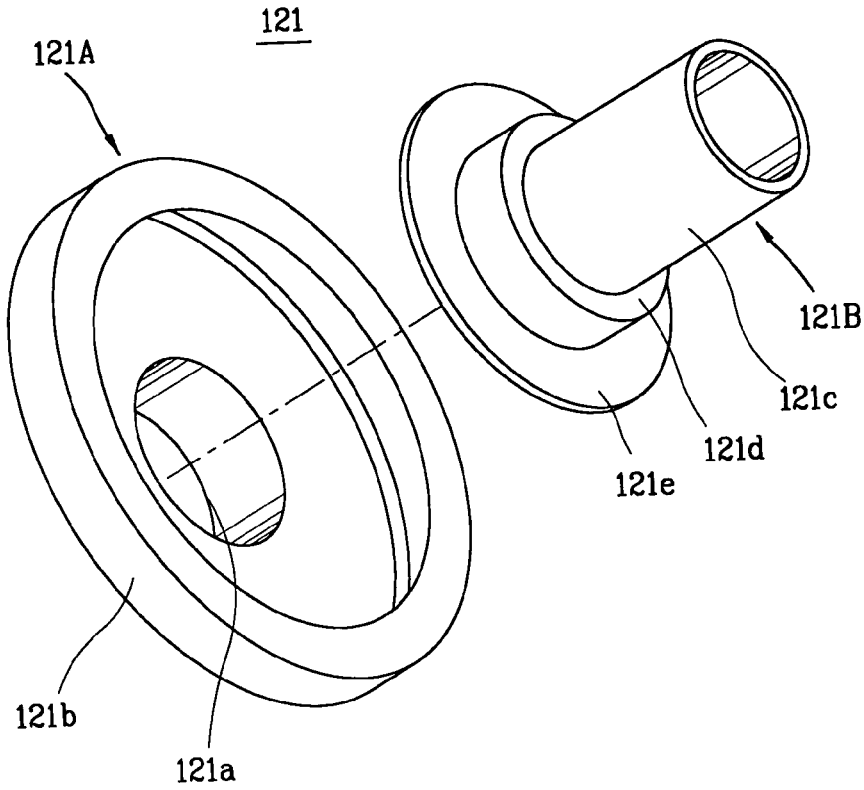
FIG. 5 is a disassembled (i.e., exploded) perspective view showing a frame of the reciprocating compressor according to the present invention.
Figure 6:
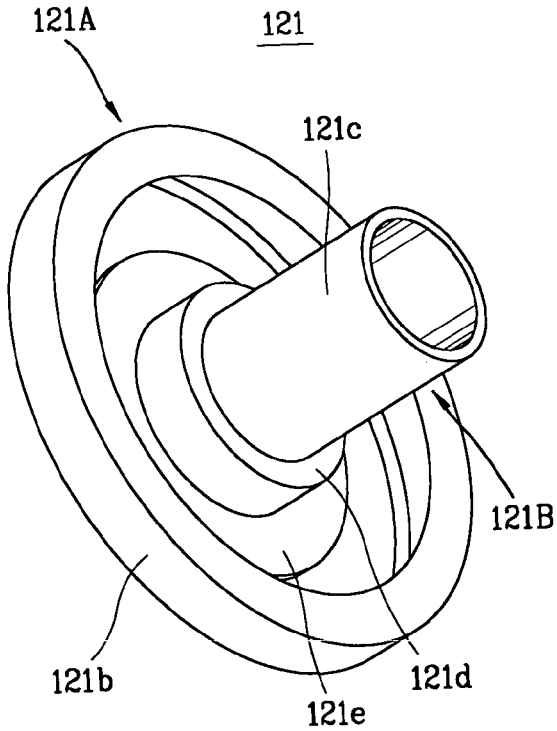
FIG. 6 is a perspective view showing the components of the frame of the reciprocating compressor engaged according to the present invention.
Figure 7:
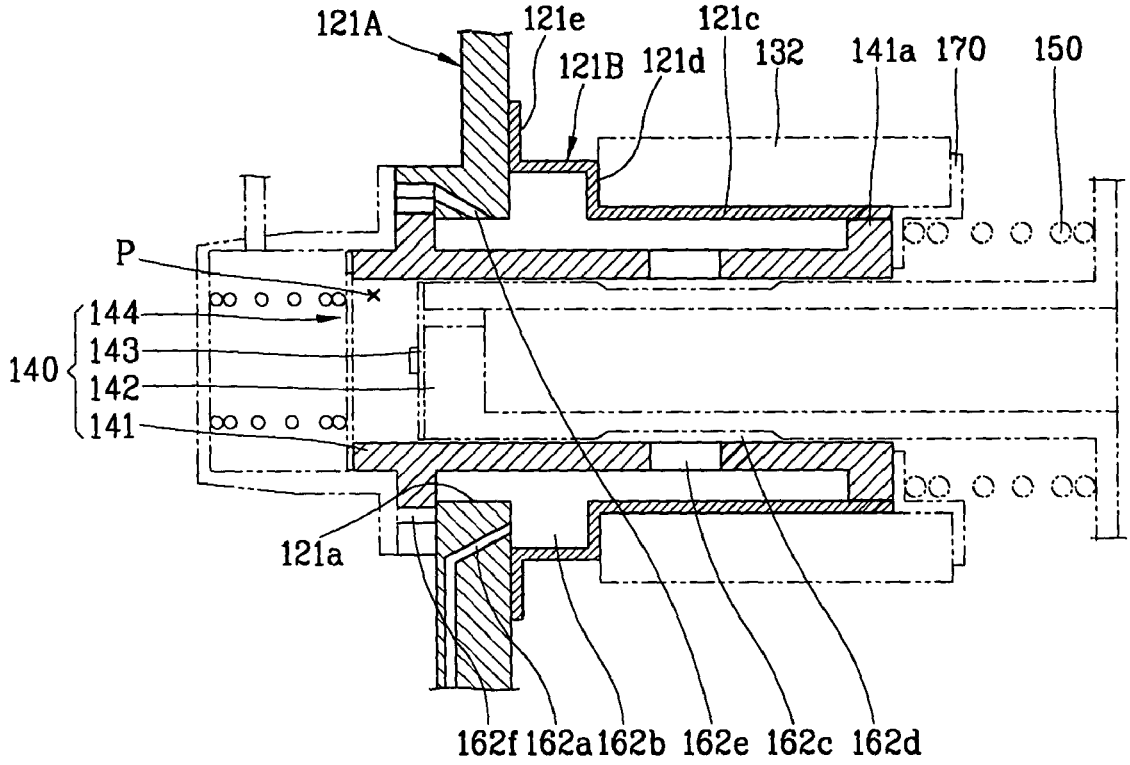
FIG. 7 is an enlarged view of a portion of FIG. 4.

FIG. 4 is a longitudinal sectional view showing a reciprocating compressor according to the present invention, FIG. 5 is a disassembled (i.e. exploded) perspective view showing a frame of the reciprocating compressor according to the present invention, FIG. 6 is a perspective view showing the frame components of the reciprocating compressor engaged according to the present invention, and FIG. 7 is an enlarged view of a portion of FIG. 4.

As shown, a reciprocating compressor according to the present invention comprises a hermetically sealed case 110, a frame 121 (FIG. 5) composed of a main frame 121A having a cylindrical insertion hole 121*a* and a flange 121*b* and a sub frame 121B engaged to the main frame 121A by a general engaging mechanism to form an oil flow path at a space between the main frame 121A and a cylinder 141. A reciprocating motor 130 is fixed to the frame 121 to linearly reciprocate a movable element 133 and a compression unit 140 takes-in, compresses and discharges gas by the movable element 133 of the reciprocating motor 130. A resonance spring unit 150 elastically supports the movable element 133 of the reciprocating motor 130 in the movement direction and an oil supply unit 161 is mounted at the frame 121 to supply oil to the compression unit 140.

A supporting member 120 comprises the frame 121 that supports the reciprocating motor 130 and the compression unit 140, a middle cover 122 that supports an outer stator 131 of the reciprocating motor 130, and a back or rear cover 123 that supports the resonance spring unit 150.

The frame 121 is composed of two components, the main frame 121A and the sub frame 121B as shown in FIG. 5. The main frame 121A has a cylindrical insertion hole 121*a* that enables insertion of the cylinder 141 of the compression unit 140 along a central axis thereof and the flange 121*b* that supports the outer stator 131 of the reciprocating motor 130 at the outer circumference thereof. The sub frame 121B is engaged to the main frame 121A by a general engaging mechanism such as bolt/nut or welding and is positioned to cover an outer circumferential surface of the cylinder to form an oil flow path in a space between the main frame 121A and the cylinder 141.

The main frame 121A is formed to have a disc shape, and the sub frame 121B engaged to the main frame 121A is formed in a cylindrical shape.

The flange 121*e* is formed at one end portion of the sub frame 121B to engage with the main frame 121A, and an inner stator installation surface 121*c* to install or receive an inner stator 132 is formed at the other end portion thereof.

Also, an oil suction path 162*a* is formed at one side of the main frame 121A by being connected to the cylinder insertion hole 121*a* in order to make the piston 142 reciprocate smoothly and to cool the cylinder 141 and the piston 142 by providing oil at a contact portion between the piston 142 and the cylinder 141. Also, an oil discharge path 162*e* is formed at another side of the main frame 121A to recollect oil.

Further, a first oil pocket 162*b* connected to the oil suction path 162*a* and the oil discharge path 162*e* is formed between the sub frame 121B and the outer circumferential surface of the corresponding cylinder 141.

The first oil pocket 162*b* is formed about the entire outer circumferential surface of the cylinder 141, differently from the conventional art.

An oil flow path closing unit 141*a* to close the first oil pocket 162*b* and to maintain an interval between the sub frame 121B and the cylinder 141 constant is formed (e.g. by bending) at the end portion of the cylinder 141.

The oil flow path closing unit 141*a* can be formed e.g. by bending the end portion of the outer circumferential surface of the cylinder 141 outwardly or by bending the end portion of the sub frame 121B inwardly.

The compression unit 140 comprises the cylinder 141, a piston 142, a suction valve 143, and a discharge valve assembly 144. Also, an oil opening 162*c* connected to the first oil pocket 162*b* is formed at a central portion of the cylinder 141.

A second oil pocket 162*d* is formed as a concavity with a predetermined depth and positioned to be connected with the oil opening 162*c* of the cylinder 141 at the outer circumference surface of the piston 142.

The main frame 121A is cut processed, manufactured of non-magnetic material such as aluminum, and the sub frame 121B is preferably fabricated of a cold rolled steel plate corresponding to non-magnetic material.

As aforementioned, the main frame 121A and the sub frame 121B are engaged to each other by a general engaging device such as bolts or welding. Herein, the main frame 121A and the sub frame 121B do not need to be completely sealed each other, rather they have only to be just sealed each other. The reason is as follows. Even if oil leaks to a gap (not shown) generated at an engaging part between the main frame 121A and the sub frame 121B, the leaked oil falls to the case 110 and recollected to the original position.

Also, in order to fix the inner stator 132 to the stator installation surface 121*c*, the stopping step 121*d* is formed at one side of the sub frame 121B, and the stopping member 170 supported by the vacuum spring unit 150 is installed at a corresponding position to the stopping step 21*d*.

By the stopping step 121*d* and the stopping member 170, the inner stator 132 is fixed to the installation surface 121*c*. Herein, the stopping member 170 can be separately formed from the sub frame 121B as shown, or can be formed as a unitary member although not shown.

The reference numeral P denotes a compression space, and 134 denotes a coil of the reciprocating motor 130.

Operations and effects of the frame of the reciprocating compressor according to the present invention are as follows.

First, the main frame 121A and the sub frame 121B are separately fabricated and sequentially assembled at the time of assembling the compressor to thus fabricate the frame 121. Accordingly, fabricating the frame 121 is facilitated.

In more detail, the main frame 121A is formed as a two-dimensional plane plate by using a sophisticated manufacturing method such as a die casting, and the cylindrical insertion hole 121*a* is formed to penetrate through the center thereof. Then, a periphery of the cylinder insertion hole 121*a*, an inner edge that supports the outer stator, and etc. are precisely processed.

On the other hand, the sub frame 121B is fabricated to have a cylindrical shape having the stopping step 121*d* by a pressing process for a plate material.

Figure 1:
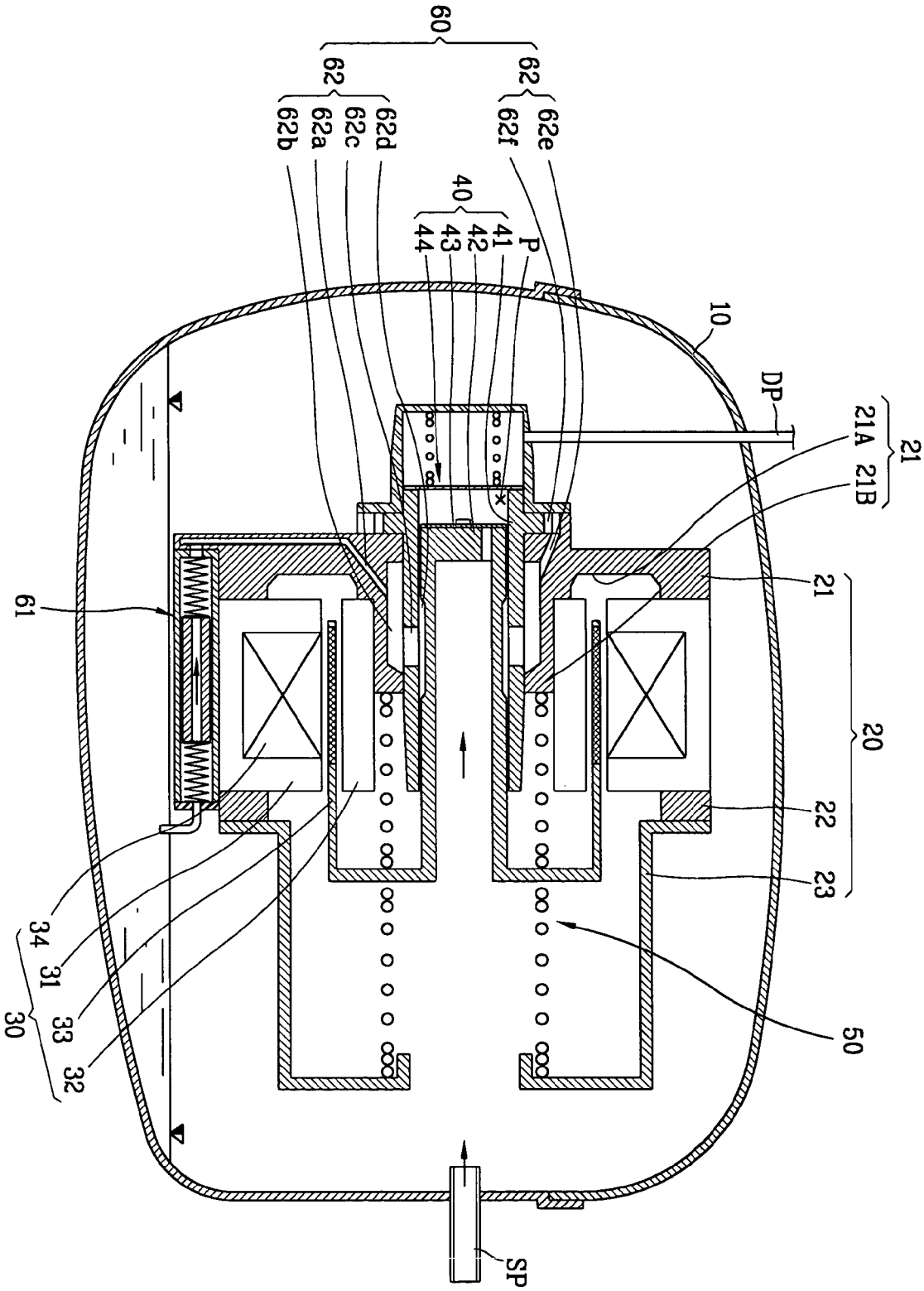
FIG. 1 CONVENTIONAL ART
FIG. 1 is a longitudinal sectional view showing a conventional reciprocating compressor.
Figure 2:
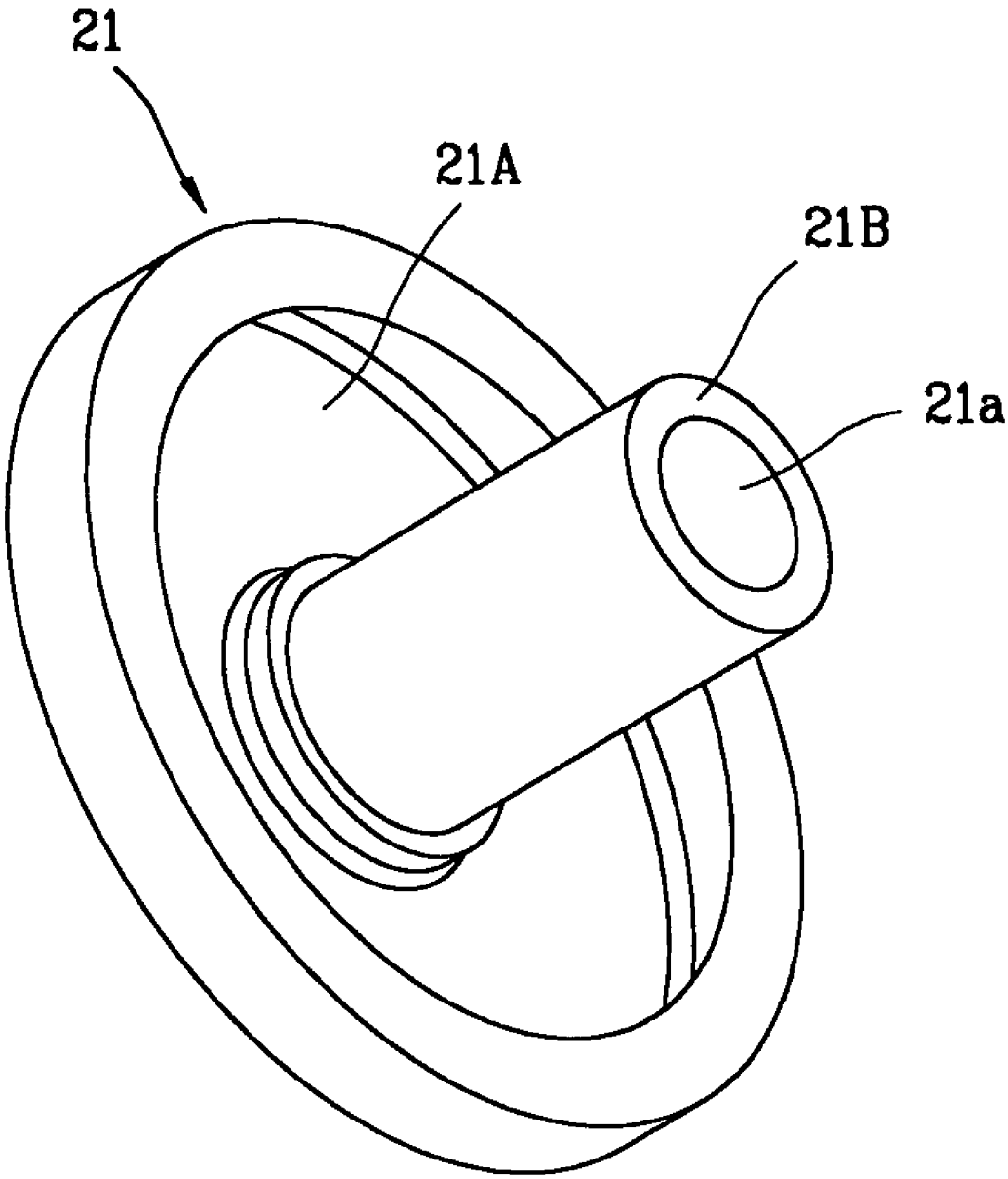
FIG. 2 CONVENTIONAL ART
FIG. 2 is a perspective view showing a frame of the conventional reciprocating compressor.
Figure 3:
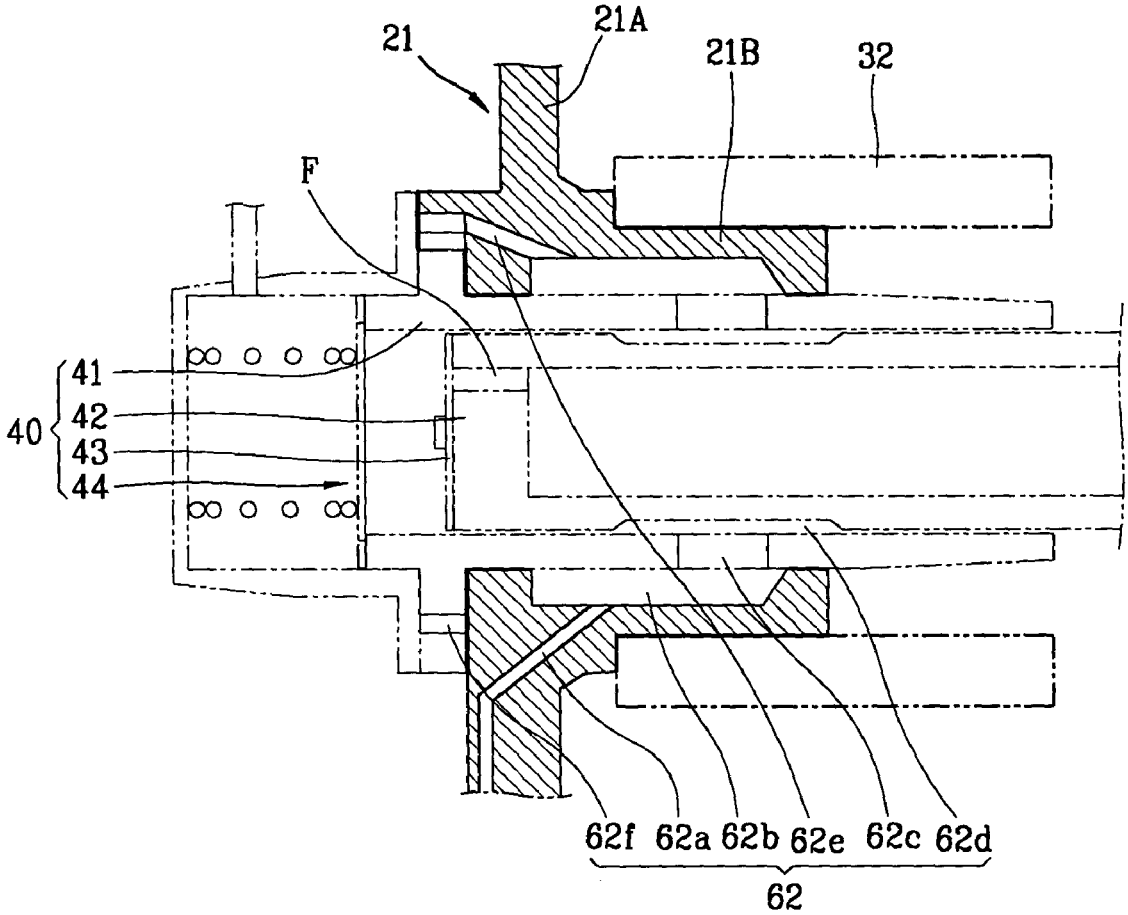
FIG. 3 CONVENTIONAL ART
FIG. 3 is an enlarged sectional view of a portion of FIG. 1.

The method in which the main frame 121A and the sub frame 121B are separately fabricated and then the two components are assembled to complete the frame 121 as described above is much easier and less expensive than the conventional method in which the frame 21 (Referring to FIG. 2) having a three-dimensional shape is fabricated by the die casting and is later processed.

When a flux is formed between the outer stator 131 and the inner stator 132 by applying current from a power source to the reciprocating motor 130 in the reciprocating compressor, the movable element 133 elastically reciprocates by the resonance spring unit 150.

At the same time, the piston 142 reciprocates in the cylinder 141, thereby sucking refrigerant gas into the compression space P, compressing, and discharging the same.

When an oil pumping unit 161 pumps oil in the case 110 to the compression unit 140, the oil is supplied to the first oil pocket 162*b*, the oil opening 162*c*, and the second oil pocket 162*d* through the oil suction hole 162*a*, thereby lubricating the contact portion between the cylinder 141 and the piston 142, thus dissipating the heat generated at the compression unit. The oil is then recollected (i.e. returned and collected) to the case 110 along the oil discharge hole 162*e* and the oil recollecting path 162*f*. The process is sequentially repeated.

In the conventional art, to increase an oil inflow amount to smoothen the lubrication performance and to increase the cooling efficiency, the oil supply flow path had to be widened by a three dimensional processing. However, the processing was very difficult since a sectional area of the oil supply flow path 162 had to be widened.

Contrary to this, in the present invention, since the frame 121 is completed by assembling the main frame 121A and the sub frame 121B together and forming the oil supply flow path therein, the sectional area of the oil supply flow path 162 can be easily widened without processing the sectional area itself.

As aforementioned, according to the present invention, the frame can be easily fabricated and the fabrication cost can be greatly reduced since the first oil pocket is formed on the entire outer circumference surface of the cylinder and the sectional area of the oil supply flow path is easily controlled.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A frame of a reciprocating compressor comprising:

a main frame having a cylindrical insertion hole configured to receive a cylinder of a compression unit along a center axis of the main frame and a flange configured to support an outer stator of a reciprocating motor at the outer circumference of the flange; and a sub frame engaged to the main frame by an engaging device and positioned to cover an outer circumferential surface of the cylinder to form an oil pocket, the oil pocket being defined by the main frame, the sub frame and the outer cylinder.

2. The frame of claim 1, wherein the main frame is configured in a disc shape, and the sub frame engaged thereto is configured as a cylindrical shape.

3. The frame of claim 1, wherein the engaging device comprises nuts and bolts.

4. The frame of claim 1, wherein the engaging device comprises a weld.

5. The frame of claim 1, wherein a flange is provided at one end portion of the sub frame and is configured to engage with the main frame, and an inner stator installation surface, configured to receive an inner stator,is provided at the other end portion of the sub frame.

6. The frame of claim 5, wherein a stopping step that fixes the inner stator is provided at one side of the inner stator installation surface and a stopper is provided at another side thereof.

7. The frame of claim 1, wherein an oil flow path closing unit is provided by a bend at an end portion of the cylinder.

8. The frame of claim 1, wherein the main frame and the sub frame comprise non-magnetic materials.

9. The frame according to claim 1, said oil pocket being configured to extend about an entire outer circumference of the cylinder.

10. The frame according to claim 1, wherein the sub frame is configured to support an inner stator of the reciprocating motor.

11. The frame according to claim 1, said main frame defining an oil path leading to the oil pocket.

12. A frame of a reciprocating compressor comprising:

a main frame having a cylindrical insertion hole configured to receive a cylinder of a compression unit along a center axis of the main frame, said main frame further having a flange configured to support an outer stator of a reciprocating motor; and a sub frame engaged to the main frame by an engaging device, and positioned to cover an outer circumferential surface of the cylinder to form an oil pocket between the main frame, the sub frame, and the outer circumferential surface of the cylinder, wherein an oil pocket closing unit is provided by a flange at an end portion of the cylinder, the flange extending outwardly from the cylinder.

13. The frame according to claim 12, wherein the main frame has a disc-shaped configuration and the sub frame has a cylindrically-shaped configuration.

14. The frame according to claim 12, wherein the engaging device comprises nuts and bolts.

15. The frame according to claim 12, wherein the engaging device comprises a weld.

16. The frame according to claim 12, wherein a flange, provided at one end portion of the sub frame, is configured to engage with the main frame, and an inner stator installation surface, configured to receive an inner stator of the reciprocating motor, is provided at an other end portion of the sub frame.

17. The frame according to claim 16, further comprising a stopping structure configured to fix the inner stator, the stopping structure being provided at one side of the inner stator installation surface, and a stopper is provided at an other side of the inner stator installation surface.

18. The frame according to claim 12, wherein the main frame and the sub frame comprise non-magnetic materials.

19. The frame according to claim 12, said oil pocket being configured to extend about an entire outer circumference of the cylinder.

20. The frame according to claim 12, said main frame defining a oil path leading to the oil pocket.

* * * * *

UNITED STATES PATENT AND TRADEMARK OFFICE

CERTIFICATE OF CORRECTION

PATENT NO. : 7,264,451 B2
APPLICATION NO. : 10/653886
DATED : September 4, 2007
INVENTOR(S) : K. Park It is certified that error appears in the above-identified patent and that said Letters Patent is hereby corrected as shown below:

At column 7, line 2 (claim 5, line 4) “starter,is” should be --starter is--.

Signed and Sealed this

Seventeenth Day of June, 2008

JON W. DUDAS
*Director of the United States Patent and Trademark Office*